US010487989B2

(12) United States Patent
Cao et al.

(10) Patent No.: US 10,487,989 B2
(45) Date of Patent: Nov. 26, 2019

(54) LED LIGHTING DEVICE

(71) Applicant: OPPLE LIGHTING CO., LTD., Shanghai (CN)

(72) Inventors: Liang Cao, Shanghai (CN); Youfeng Chen, Shanghai (CN)

(73) Assignee: OPPLE LIGHTING CO., LTD., Shanghai (CN)

( * ) Notice: Subject to any disclaimer, the term of this patent is extended or adjusted under 35 U.S.C. 154(b) by 0 days.

(21) Appl. No.: 15/900,340

(22) Filed: Feb. 20, 2018

(65) Prior Publication Data

US 2018/0252369 A1 Sep. 6, 2018

(30) Foreign Application Priority Data

Mar. 2, 2017 (CN) ..... 2017 2 0195076

(51) Int. Cl.

| | |
|---|---|
| ***F21K 9/237*** | (2016.01) |
| ***F21V 29/70*** | (2015.01) |
| ***F21K 9/238*** | (2016.01) |
| ***F21V 17/12*** | (2006.01) |
| ***F21K 9/90*** | (2016.01) |
| ***F21K 9/235*** | (2016.01) |
| ***F21V 29/503*** | (2015.01) |
| ***F21V 23/00*** | (2015.01) |
| ***F21K 9/232*** | (2016.01) |
| ***F21Y 105/18*** | (2016.01) |
| ***F21Y 115/10*** | (2016.01) |

(52) U.S. Cl.

CPC ..... *F21K 9/237* (2016.08); *F21K 9/232* (2016.08); *F21K 9/235* (2016.08); *F21K 9/238* (2016.08); *F21K 9/90* (2013.01); *F21V 17/12* (2013.01); *F21V 23/005* (2013.01); *F21V 29/503* (2015.01); *F21V 29/70* (2015.01); *F21Y 2105/18* (2016.08); *F21Y 2115/10* (2016.08)

(58) Field of Classification Search

CPC ..... F21K 9/233; F21K 9/235; F21K 9/237; F21K 9/238; F21V 29/70; F21Y 2105/18

See application file for complete search history.

(56) References Cited

U.S. PATENT DOCUMENTS

| | | | | |
|---|---|---|---|---|
| 9,408,282 | B1 * | 8/2016 | Springer | H05B 37/0272 |
| 2010/0277082 | A1 * | 11/2010 | Reed | F21V 23/0478 315/159 |
| 2011/0101861 | A1 * | 5/2011 | Yoo | F21V 3/02 315/35 |
| 2014/0301080 | A1 * | 10/2014 | Lim | H05K 3/366 362/249.01 |
| 2016/0234414 | A1 * | 8/2016 | Chen | H04N 7/183 |

* cited by examiner

*Primary Examiner* — Alexander K Garlen
(74) *Attorney, Agent, or Firm* — Arch & Lake LLP

(57) ABSTRACT

The present disclosure discloses an LED lighting device, which includes a head portion, a heat sink, a mounting portion, a lighting circuit and an optical element. The head portion is configured for mounting the LED lighting device to an outer installation device and electrically connecting the LED lighting device with an outer power source. The lighting circuit includes a circuit board and at least one LED light source arranged on one surface of the circuit board. The lighting circuit is held between the mounting portion and the optical element, and light emitted from the at least one LED light source is output after distributed by the optical element. The heat sink is held between the head portion and the mounting portion.

19 Claims, 7 Drawing Sheets

LED LIGHTING DEVICE

CROSS-REFERENCE TO RELATED APPLICATIONS

This application is based upon and claims priority to Chinese Application No. 201720195076.3 filed Mar. 2, 2017, the entire content of which is incorporated herein by reference for all purpose.

TECHNICAL FIELD

The present disclosure relates to an illumination device, especially to an LED lighting device and a method of making an LED lighting device.

BACKGROUND

In lamps, lighting sources are replaced more and more by light-emitting diodes (LED) lighting sources. Some of the lamps with simpler structure are equipped with a single LED bulb or a single LED candle bulb. However, due to space and volume constraints, such kinds of products cannot arrange a sufficient number of the LED bulb or LED candle bulb and have limited power, which cannot satisfy higher power needs. If high-power lighting is needed, more lighting sources may be needed to be arranged, such as LED light sources. However, the space is limited for the existing LED bulbs or LED candle bulbs; if more LED light sources are needed to be arranged, they may be arranged in height direction and circumferential direction, accordingly, light source substrates need to be arranged in different directions. Therefore, the structure would be more complicated and the cost would be increased.

SUMMARY

The present disclosures provides an LED lighting device and a method of making an LED lighting device.

According to a first aspect, the present disclosure provides an LED lighting device. The LED lighting device may include a head portion, a heat sink, a mounting portion, a lighting circuit and an optical element. The head portion is configured for mounting the LED lighting device to an outer installation device and electrically connecting the LED lighting device with an outer power source. The lighting circuit comprises a circuit board and at least one LED light source arranged on one surface of the circuit board. The lighting circuit is held between the mounting portion and the optical element, and light emitted from the at least one LED light source is output after distributed by the optical element. The heat sink is held between the head portion and the mounting portion, and at least a portion of the circuit board of the lighting circuit or the heat sink penetrates the mounting portion to make a direct thermal contact between the heat sink and the lighting circuit.

According to a second aspect, the present disclosure provides a method of making an LED lighting device. The method may include providing a head portion that is configured for mounting the LED lighting device to an outer installation device and electrically connecting the LED lighting device with an outer power source; providing a lighting circuit that includes a circuit board and at least one LED light source arranged on one surface of the circuit board, where the lighting circuit is held between a mounting portion and an optical element, and light emitted from the at least one LED light source is output after distributed by the optical element; and providing a heat sink that is held between the head portion and the mounting portion, where at least a portion of the circuit board of the lighting circuit or the heat sink penetrates the mounting portion to make a direct thermal contact between the heat sink and the lighting circuit.

It is to be understood that both the forgoing general description and the following detailed description are exemplary and illustrative only, and do not limit the present disclosure.

BRIEF DESCRIPTION OF THE DRAWINGS

To explain the technical solutions in the examples of the present disclosure, hereinafter, the drawings required for describing the examples will be introduced. The drawings described below are only some examples in the present disclosure. Other drawings may be obtained according to these drawings.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various examples of the present disclosure. Also, common but well-understood elements that are useful or necessary in a commercially feasible example are often not depicted in order to facilitate a less obstructed view of these various examples. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above, except where different specific meanings have otherwise been set forth herein.

DETAILED DESCRIPTION

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The applicant files a Chinese application on Jun. 30, 2015 in title of "an LED lighting device", which is published in CN 2050019030 on Jan. 27, 2016 and provides an LED lighting device having high power and a large number of LED light sources. The entire content of which is incorporated herein by reference. However, multiple LED light sources will generate more heat. For LED lighting sources, heat is an important influence factor on lifetime and luminous efficiency. Therefore, in order to provide an LED lighting device with better performance, the applicant has improved the design of the LED lighting device.

Figure 1:
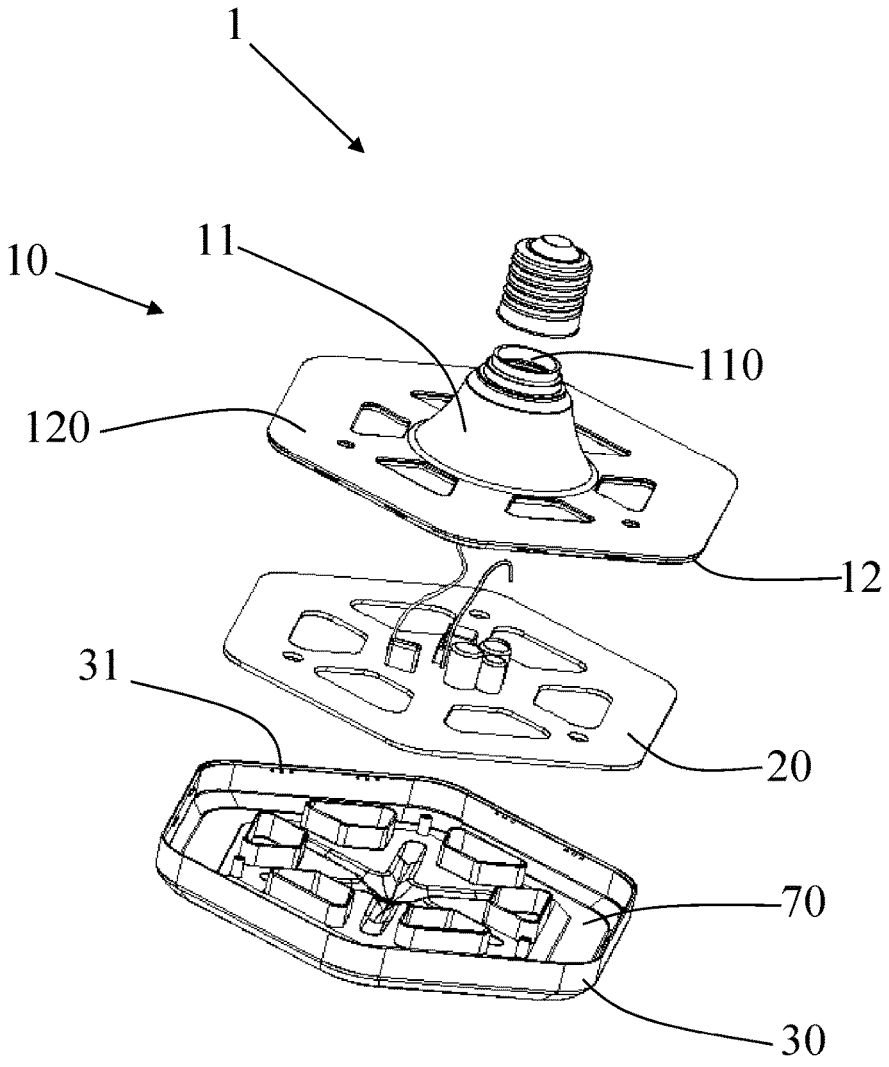
FIG. 1 is an exploded perspective view of an LED lighting device in accordance with a first example of the present disclosure.
Figure 2:
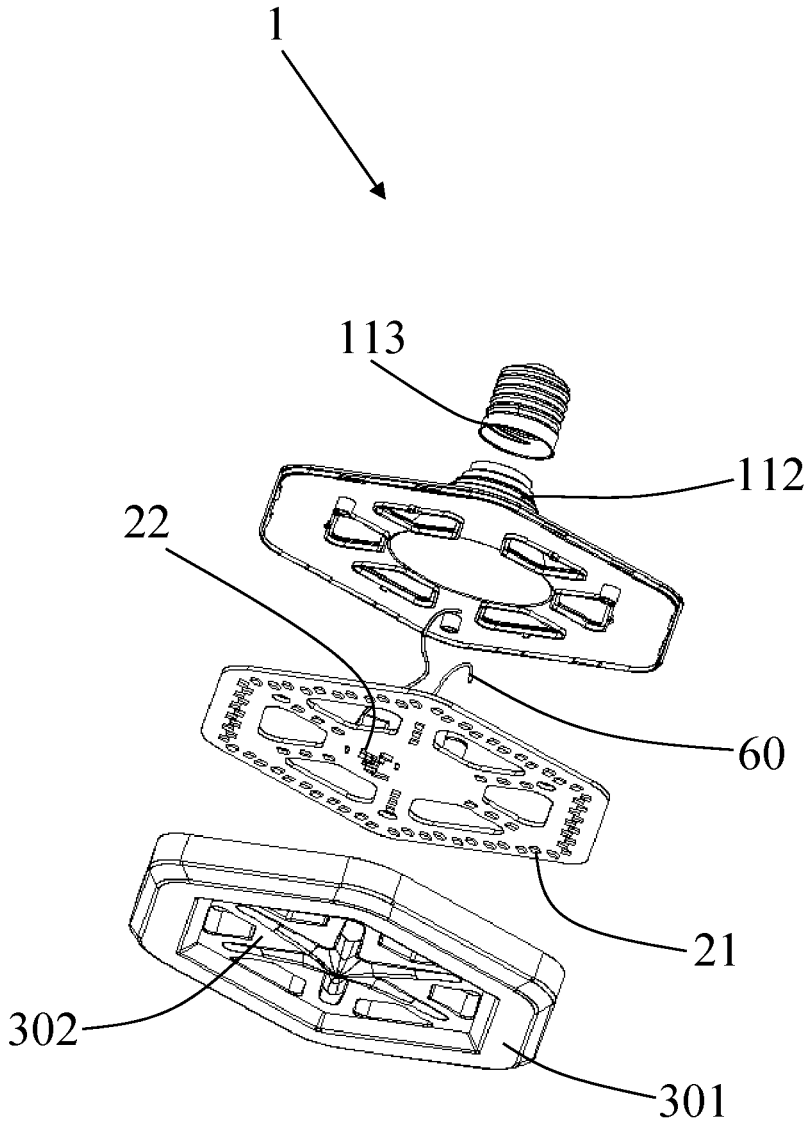
FIG. 2 is an exploded perspective view of an LED lighting device of FIG. 1 observed from another viewing angle.
Figure 3:
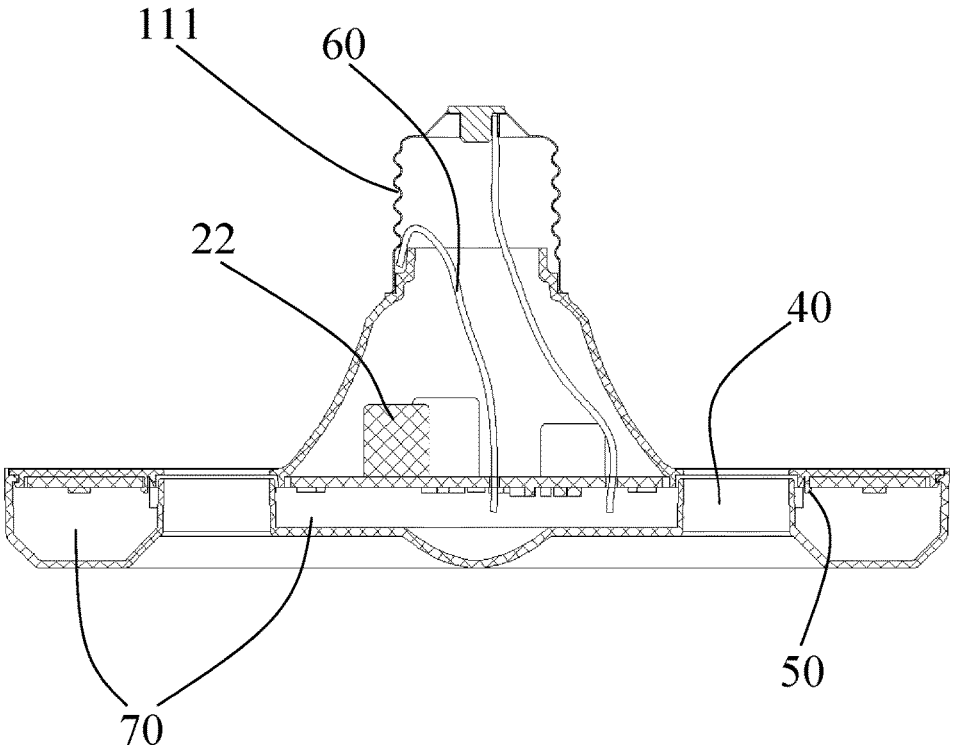
FIG. 3 is a cross-section view of the LED lighting device in accordance with the first example of the present disclosure.
Figure 4:
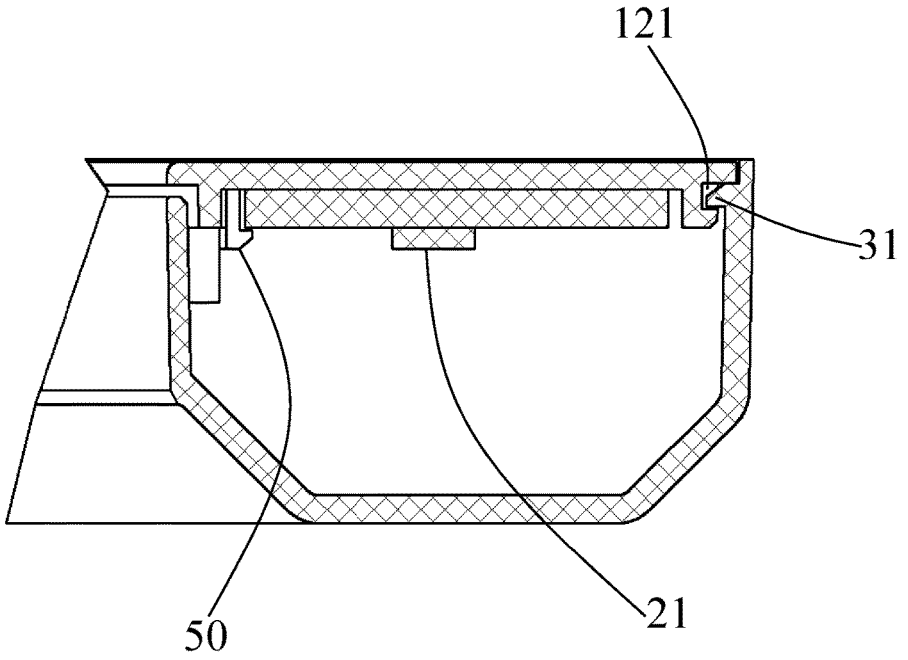
FIG. 4 is a partially enlarged view of FIG. 3.

With reference to FIGS. 1 and 4, an LED lighting device 1 in accordance with a first example of the present disclosure is of direct-down type and has a mounting direction along an up and down direction. The LED lighting device 1 comprises a base 10, a lighting module 20, and an optical element 30.

The base 10 comprises a head portion 11 and a mounting portion 12 which extends outwards from the lower peripheral edge of the head portion 11 to form a flat main portion 120. The head portion 11 is adapted for mounting the LED lighting device 1 to an outer installation device (not shown) and electrically connecting the LED lighting device 1 with an outer power source (not shown). The lighting module 20 is mounted to the flat main portion 120 of the mounting portion 12, and the optical element 30 is connected to the base 10. The lighting module 20 comprises a flat circuit board 22 and a plurality of LED light sources 21 for emitting light. The flat circuit board 22 and the flat main portion 12 of the mounting portion 12 are attached to each other in a face-to-face manner, so as to form a maximum contact area for better heat dissipation during the LED light sources 21 in operation state. The head portion 11 and the lighting module 20 are respectively located at different sides of the mounting portion 12. The mounting portion 12 and the optical element 30 together define a closed accommodating space 70. The lighting module 20 is disposed in the accommodating space 70, and the head portion 11 is connected to the external end of the mounting portion 12 distal to the accommodating space 70. The traditional light sources can be replaced with the LED lighting device 1 of the present disclosure conveniently, such that an illumination device with higher power can be easily obtained. The base 10 may be made of insulation material to increase safety of the LED lighting device 1. In the example of the present disclosure, the base 10 and the optical element 30 are both made of insulation materials; while in alternative examples, the base 10 may made of metal or other heat dissipation materials according to practical requirements. At the same time, in the example of the present disclosure, since the outer contour of the circuit board 22 is a polygon, such as a hexagon, the LED light sources 21 are arranged in sawtooth form along an outer periphery of the circuit board 22, and distributed along a straight line or smooth curved line, such that each LED light source 21 is connected with a copper foil with a maximized area, thereby achieving better heat dissipation for the LED light sources. In an alternative example, the LED light sources 21 may be distributed along a straight line or smooth curved line.

Since both the flat mounting portion 12 and the circuit board 22 below the head portion 11 are extended in a horizontal direction to make themselves to be flat, the area of mounting surface becomes larger and more LED light sources 21 can be arranged, thereby increasing the power of the LED lighting device 1, and satisfying the high power requirements.

The LED lighting device 1 comprises a plurality of hand-handling sections 40 which at least recess from a surface of the optical element 30 into some recesses (not labeled). In the example of the present disclosure, the hand-handling sections 40 are through openings penetrating the optical element 30, the circuit board 22 of the lighting module 20 and the mounting portion 12 of the base 10. The hand-handling sections 40 are convenient for being held as the LED lighting device 1 assembled. Hence, in the example of the present disclosure, the size of each through opening 40 is suitable for a finger to pass through or smaller only if it is convenient to be held. The hand-handling sections 40 are not necessary to penetrate the optical element 30, the circuit board 22 and the mounting portion 12. The hand-handling sections could only penetrate the optical element 30 and the circuit board 22, or only penetrate the optical element 30 or only be recesses in the optical element 30 as mentioned above.

The outer contour of the optical element 30, the circuit board 22 of the lighting module 20 and the mounting portion 12 of the base 10 match with one another and are polygons for being assembled along the mounting direction. In the example of the present disclosure, the outer contour of the optical element 30, the circuit board 22 of the lighting module 20 and the mounting portion 12 of the base 10 are hexagons and also the LED lighting sources 21 are arranged into hexagon shape.

The optical element 30 comprises a recessed closed optical portion 301 arranged on an outer periphery thereof and at least two connecting portions 302 which connect the center of the optical element 30 and inner periphery side of the optical portion 301. The hand-handling sections 40 are arranged between the connecting portions 302. The lower outer surface (not labeled) of the optical portion 301 is lower than that of the connecting portions 302 along the mounting direction.

The head portion 11 comprises an intermediate section 112 with outer thread thereon connecting with the mounting portion 12 and a head section 113 with inner thread and outer thread which connects the intermediate section 112 by the threads. The head section 113 also electrically connects with outer power source and the circuit board 22 thus to supply power to the LED lighting device 1. In the example of the present disclosure, the intermediate section 112 is integrated with the mounting portion 12. The head section 113 connects with the intermediate section 112 by threads. However, in alternative examples, the intermediate section 112 and the mounting portion 12 could be made separately and assembled to each other. The head section 113 and the intermediate section 112 also could be assembled to each other by other means. The head section 113 could be standard lamp holders, such as E27 lamp holder, E14 lamp holder, MR16 lamp holder etc. The through openings 40 (the hand-handling portions 40) penetrate the mounting portion 12 and surround the lower contour of the head portion 11.

The lighting module 20 also comprises driving elements 23 which could be arranged on the same surface, that is the lower surface 221 of the circuit board 22, as the LED light sources 21, or the other different surface, that is the upper surface 222 of the circuit board 22, or on both surfaces 221, 222 of the circuit board 22. In the example of the present disclosure, the driving elements 23 are partially arranged on the upper surface 222 and partially arranged on the lower surface 221. The intermediate section 112 of the head portion 11 is defined with a receiving space 110 which receive part of the driving elements 23 arranged on the upper surface 222 of the circuit board 22 therein. In alternative examples, the arrangement of the driving elements 23 could be different according to needs. The LED lighting device 1 also comprises at least one wire 60 which connects the driving elements 23 with the head section 113 which has conductive section 111 on an outer periphery thereof. In alternative examples, the driving elements 23 also could electrically connect with the conductive section 111 of the head portion 11 by other means such as electrical connectors, such as an adapt circuit board etc. In the example of the present disclosure, the driving elements 23 are arranged in the central area of the circuit board 22 while the LED light sources 21 surround the driving elements 23. In alternative examples, the arrangement of the LED light sources 21 and the driving elements 23 on the circuit board 22 could be different according to needs, for example, the LED light sources 21 are arranged on the central area of the circuit board 22 and the driving elements 23 are arranged to surround the LED light sources 21. According to the arrangement of the LED light sources 21 and the driving elements 23, the optical element 30 has lower light transmittance of a central area thereof or light-proof to cover the driving elements 23 on the central area of the circuit board 20, and higher light transmittance on periphery area thereof corresponding to the LED light sources 21. In alternative examples, the optical portion of the optical element 30 could be different according to the arrangement of the LED light sources 21. The through openings 40 penetrating the circuit board 22 are arranged between the driving elements 23 and the LED light sources 21, it could be understood that the through openings surround the driving elements 23 in the example of the present disclosure.

The LED lighting module 20 and the base 10 are assembled to each other by latching means. In the example, the LED lighting device 1 provides a plurality of latching portions 50 which could be arranged on the circuit board 22 or the base 10 to latch the LED lighting module 20 and the base 10 together. In the example of the present disclosure, the latching portions 50 are provided on the mounting portion 12 of the base 10 and near to the through openings 40. The latching portions 50 extend through the through openings 40 and latch on the lower surface 221 of the circuit board 22.

The optical element 30 and the base 10 are also arranged to latch with each other to hold the LED lighting module 20 therebetween by latching means. In the example of the present disclosure, the optical element 30 is provided with some fixed portions 31, while the mounting portion 12 is provided with some fixed sections 121. The fixed portions 31 are recesses or latches, while the fixed sections 121 are latches or recesses correspondingly. Thus, the mounting portion 12 latches with each the optical element 30 and the circuit board 22, which makes the assembly more convenient and obtains higher efficiency.

Figure 5:
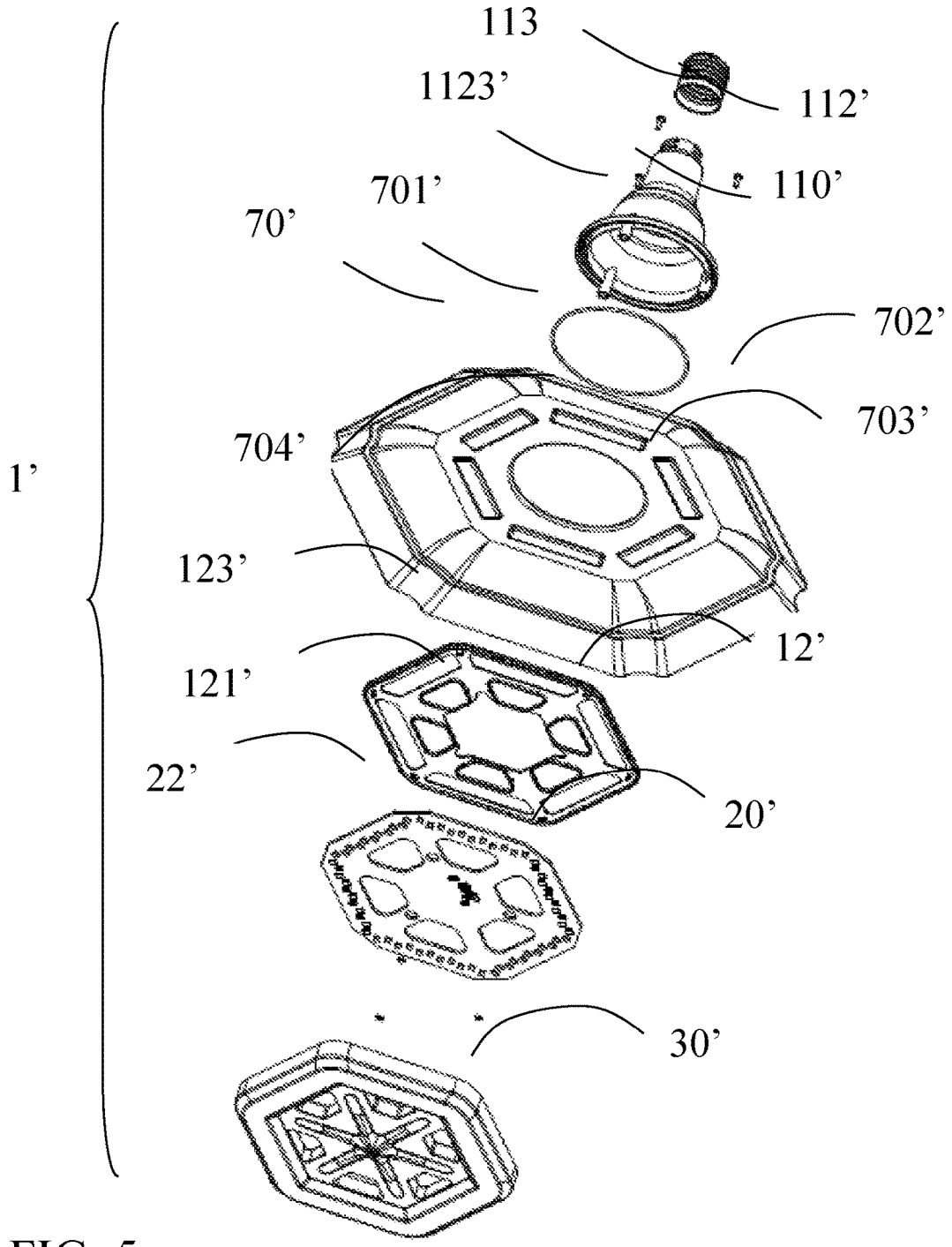
FIG. 5 is an exploded perspective view of an LED lighting device in accordance with a second example of the present disclosure.
Figure 6:
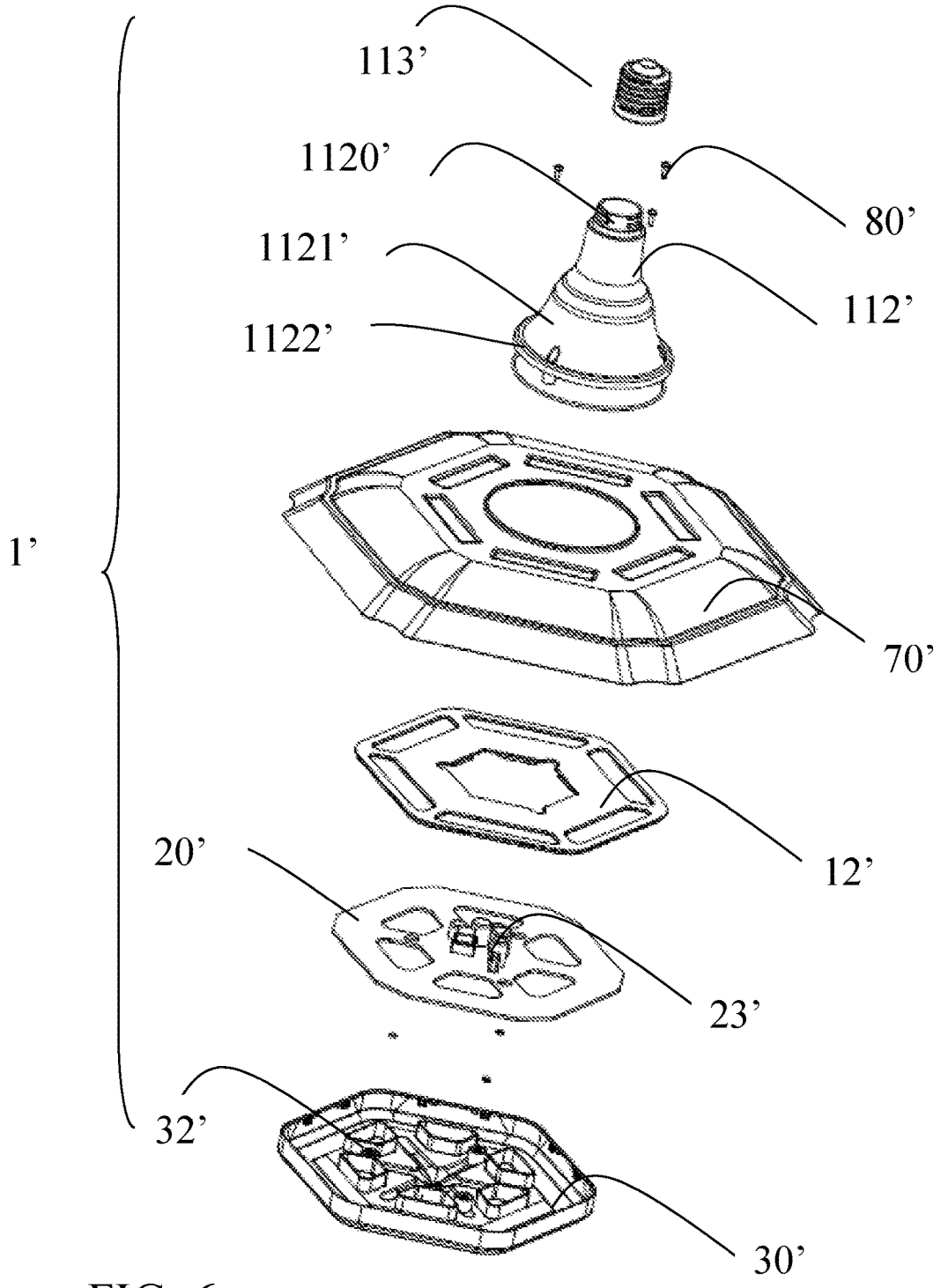
FIG. 6 is an exploded perspective view of an LED lighting device of FIG. 5 observed from another viewing angle.
Figure 7:
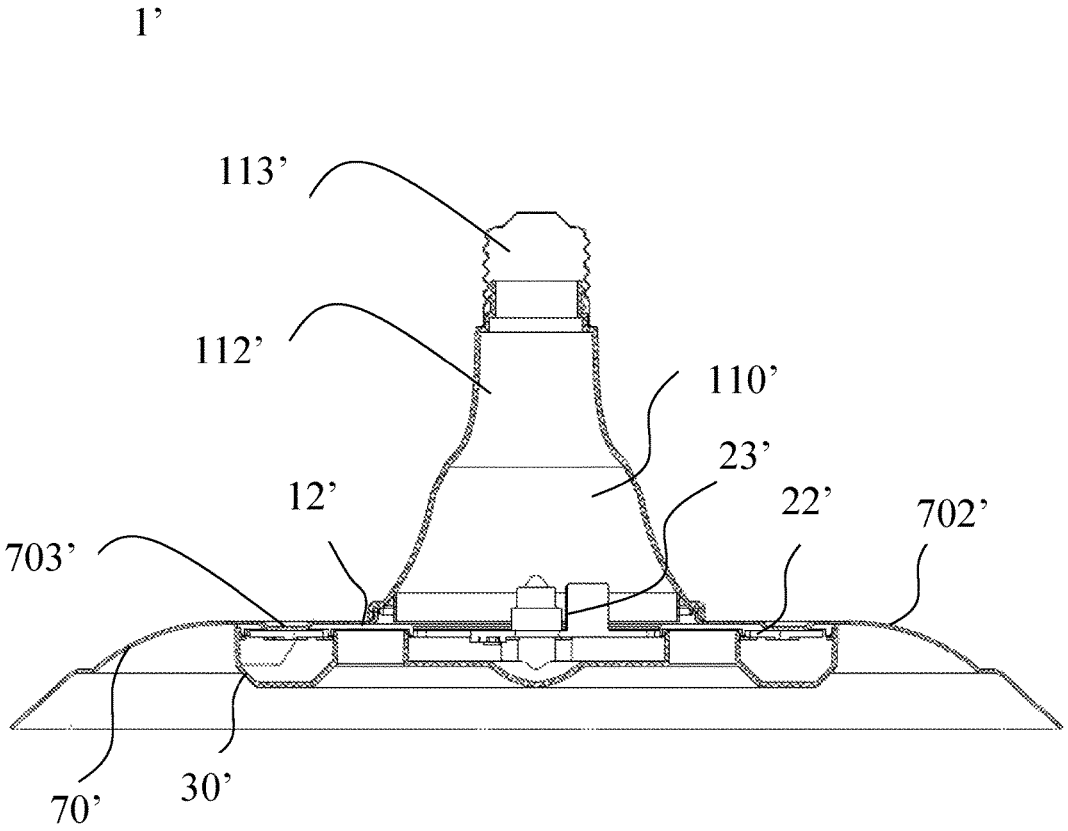
FIG. 7 is a cross-section view of the LED lighting device in accordance with the second example of the present disclosure.

With reference to FIGS. 5-7, which illustrate an LED lighting device 1' in accordance with a second example of the present disclosure. The LED lighting device 1' comprises a head portion, a heat sink 70', a mounting portion 12', a lighting module 20', and an optical element 30'; the head portion comprises an intermediate section 112' and a head section 113'. As illustrated in the drawings, the difference between the LED lighting device 1' of the second example and the LED lighting device 1 of the first example is that the heat sink 70' is provided in the second example. In order to assemble the heat sink 70' into the LED lighting device 1', a set of screws 80' is provided to penetrate the lower portion of the intermediate section 112', and further penetrate the heat sink 70', the mounting portion 12', the circuit board 22' of the lighting module 20' successively. Finally, the screws 80' are latched with the optical element 30', so as to sandwich the heat sink 70' between the intermediate section 112' and the mounting portion 12'.

Specifically, the intermediate section 112' comprises a head 1120' which is located at an upper end of the intermediate section 112' and mechanically and electrically connected with the head section 113', and a main portion 1121' formed by extending from a lower end of the head 1120'. The main portion 1121' is provided with a receiving space 110'. Further, a stopping portion 1122' with a slightly larger size is formed at lower peripheral edge of the main portion 1121', and the stopping portion 1122' is in a shape of annular. A plurality of hollow studs 1123' extended beyond the stopping portion 1122' are arranged at lower peripheral edge of the intermediate section 112' with intervals therebetween.

The heat sink 70' is made of thermal conductive materials, including, but not limited to, metals and thermal conductive plastics. The heat sink 70' comprises a flat main portion 701' and an extension 702' formed by extending outwards from an outer periphery of the main portion 701'. A circular opening 704' is arranged in a middle of the main portion 701' and is aligned with a corresponding opening arranged in the middle of the mounting portion 12', in order to make a driving element 23' of the lighting module 20' penetrate and finally be received in the receiving space 110' of the intermediate section 112'. The size of the stopping portion 1122' of the intermediate section 112' is larger than that of the opening 704', so the intermediate section 112' could be arranged on the heat sink 70' and near the opening 704'. The plurality of screws 80' penetrate through the studs 1123', the opening 704' of the heat sink 70', and the opening of the mounting portion 12', and are then latched with the studs 32' of the optical element 30', thereby fixing the heat sink 70'.

A plurality of thermal contact portions 703' surrounding the opening 704' are embossed from the main portion 701' to the lighting module. Correspondingly, a plurality of slots 123' with internals therebetween are arranged on the mounting portion 12' at outer periphery of through openings 40'. The size of the thermal contact portion 703' is slightly smaller than that of the slot 123', thermal contact portions 703' penetrate the slots 123' to make a thermal contact to an upper surface of the circuit board 22' of the lighting module 20'. The locations of the thermal contact portions 703' being contacted with the circuit board 22' are aligned with the LED light sources 21' arranged on another surface (lower surface) of the circuit board 22' along up and down direction (mounting direction), thereby the heat generated by the LED light sources 21' in operating state can be directly dissipated to the entire heat sink 70' by the thermal contact portions 703' in thermal contact with the circuit board 22', so as to achieve rapid heat dissipation and improve the optical performance and lifetime of the LED lighting device 1'. In other alternative examples, the thermal contact portion 703' and the circuit board 22' may be interchangeable and not limited to the structures disclosed in the drawings, as long as the direct contact is satisfied. In other alternative examples, the thermal contact portion 703' may also be in a shape of annular and concentric with the opening 704' and surround the opening 704', accordingly, the slots of the mounting portion 12' may be arranged in a shape of annular, in order to make the thermal contact portions 703' penetrate therethrough and be arranged on the upper surface of the circuit board 22'. Such a configuration can further increase the contact area between the heat sink 70' and the lighting module 20', and dissipate the heat better and faster.

It is an object of the present disclosure to provide an LED lighting device with better heat dissipation effect.

According to the disclosure, the LED lighting device comprises a head portion, a heat sink, a mounting portion, a lighting circuit and an optical element. The head portion is configured for mounting the LED lighting device to an outer installation device and electrically connecting the LED lighting device with an outer power source. The lighting circuit comprises a circuit board and at least one LED light source arranged on one surface of the circuit board. The lighting circuit is held between the mounting portion and the optical element, and light emitted from the at least one LED light source is output after distributed by the optical element. The heat sink is held between the head portion and the mounting portion, and at least a portion of the circuit board of the lighting circuit or the heat sink penetrates the mounting portion to make a direct thermal contact between the heat sink and the lighting circuit.

Optionally, the location of a thermal contact portion of the heat sink in the direct thermal contact with the circuit board of the lighting circuit is aligned with the LED light sources arranged on another surface of the circuit board along a mounting direction.

Optionally, at least one thermal contact portion is embossed from the heat sink to the lighting circuit, and at least one slot having a size slightly larger than that of at least one thermal contact portion is arranged in the mounting portion, wherein the at least one thermal contact portion penetrates the at least one slot and is configured to attach to and in thermal contact with the circuit board of the lighting circuit, and the location of the thermal contact portions in contact with the circuit board are aligned with the LED light sources arranged on another surface of the circuit board.

Optionally, an opening is arranged in a middle of the heat sink, the heat sink is provided with a plurality of thermal contact portions arranged along an outer periphery of the opening of the heat sink, at least one slot is arranged in the mounting portion correspondingly, wherein each of the thermal contact portions are attached to the circuit board of the lighting circuit.

Optionally, an opening is arranged in a middle of the heat sink, and a corresponding opening is arranged in the mounting portion, a driving element is arranged on at least one surface of the lighting circuit which is not provided with the LED light sources, wherein the driving element penetrates the openings of the mounting portion and the heat sink, and is accommodated in the head portion.

Optionally, the LED lighting device is of straight-down type, and the respective elements of the LED lighting device are arranged along an up and down direction; light emitted from the LED light sources are output downwardly.

Optionally, the mounting portion and the optical element are connected with each other to assemble the lighting circuit, the mounting portion and the optical element together.

Optionally, the heat sink, the mounting portion and the circuit board of the lighting circuit each comprises at least a portion in flat form, and are arranged face to face with each other.

Optionally, the heat sink has a flat main portion and an extension formed by extending outwards from an outer periphery of the main portion; wherein an area of the main portion is substantially same as the area of the mounting portion, the area of the lighting circuit and the area of the optical element, and the extension extends beyond the outer peripheries of the mounting portion, the lighting circuit, and the optical element.

Optionally, the heat sink has a flat main portion and an opening arranged in a middle of the main portion; a lower contour of the head portion is arranged on an outer periphery of the opening.

Optionally, the head portion comprises a head section and an intermediate section which are connected with each other, and a maximum outer diameter of the intermediate section is larger than a diameter of the opening of the heat sink.

Optionally, the LED lighting device further comprises a plurality of screws, a plurality of studs are arranged on the head portion, and the screws penetrate through the studs of the head portion, the heat sink, the mounting portion, and the lighting circuit, to latch with the optical element.

Optionally, the LED light sources of the lighting module are arranged along an outer periphery of the circuit board, and the optical element is arranged with a recessed annular optical portion which is configured to receive the light emitted from the LED light sources and output the light after the light is distributed.

Optionally, the optical element comprises some connecting portions with one end of each connecting portion extending from the center of the optical element and the other end connecting with the inner periphery side of the optical portion.

Optionally, the optical element is an optical lens or a diffusion element.

According to a second aspect, the present disclosure provides a method of making an LED lighting device. The method may include providing a head portion that is configured for mounting the LED lighting device to an outer installation device and electrically connecting the LED lighting device with an outer power source; providing a lighting circuit that includes a circuit board and at least one LED light source arranged on one surface of the circuit board, where the lighting circuit is held between a mounting portion and an optical element, and light emitted from the at least one LED light source is output after distributed by the optical element; and providing a heat sink that is held between the head portion and the mounting portion, where at least a portion of the circuit board of the lighting circuit or the heat sink penetrates the mounting portion to make a direct thermal contact between the heat sink and the lighting circuit.

Optionally, a location of a thermal contact portion of the heat sink in the direct thermal contact with the circuit board of the lighting circuit is aligned with the LED light sources arranged on another surface of the circuit board along a mounting direction.

Optionally, at least one thermal contact portion is embossed from the heat sink to the lighting circuit, and at least one slot having a size slightly larger than that of at least one thermal contact portion is arranged in the mounting portion, wherein the at least one thermal contact portion penetrates the at least one slot and is configured to attach to and in thermal contact with the circuit board of the lighting circuit, and the location of the thermal contact portions in contact with the circuit board are aligned with the LED light sources arranged on another surface of the circuit board.

Optionally, an opening is arranged in a middle of the heat sink, the heat sink is provided with a plurality of thermal contact portions arranged along an outer periphery of the opening of the heat sink, at least one slot is arranged in the mounting portion correspondingly, wherein each of the thermal contact portions are attached to the circuit board of the lighting circuit.

Optionally, an opening is arranged in a middle of the heat sink, and a corresponding opening is arranged in the mounting portion, a driving element is arranged on at least one surface of the lighting circuit which is not provided with the LED light sources, wherein the driving element penetrates the openings of the mounting portion and the heat sink, and is accommodated in the head portion.

Compared with the other implementations, the LED lighting device provided in the present disclosure has the following advantages: higher power and better heat dissipation are easily realized by adding the heat sink, and the LED lighting device is more simple and convenient to be assembled.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the computing system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors.

It should be noted that the examples of the present disclosure are well implementable, and do not make limitations of any form to the present disclosure. Any changes or modifications that may be made by the technicians familiar with this field using the above-disclosed technical contents are equally effective examples. Any modifications or equivalent changes and polishes made on the above-described examples, which are not independent of the contents of the technical schemes of the present disclosure, and are in accordance with the technical essence of the present disclosure, are still covered in the scope of the technical schemes of the present disclosure.

The foregoing is only the examples of the present disclosure and not intended to limit the present disclosure. Various modifications and changes may be made to the present disclosure by those skilled in the art. Any modification, equivalent replacement, improvement or the like made within the spirit and the principle of the present disclosure shall fall within the scope of protection of the present disclosure.

What is claimed is:

1. An LED lighting device, comprising a head portion, a heat sink, a mounting portion, a lighting circuit and an optical element; wherein:

the head portion is configured for mounting the LED lighting device to an outer installation device and electrically connecting the LED lighting device with an outer power source;

the lighting circuit comprises a circuit board and at least one LED light source arranged on one surface of the circuit board; the lighting circuit is held between the mounting portion and the optical element, and light emitted from the at least one LED light source is output after being distributed by the optical element; and the heat sink is held between the head portion and the mounting portion and includes a flat main portion and an extension formed outwards from an outer periphery of the flat main portion where the extension extends beyond the outermost peripheries of the mounting portion, the lighting circuit, and the optical element, in both a radial direction and a light emission direction and at least a portion of the circuit board of the lighting circuit or the heat sink penetrates the mounting portion to make a direct thermal contact between the heat sink and the lighting circuit.

2. The LED lighting device according to claim 1, wherein a location of a thermal contact portion of the heat sink in the direct thermal contact with the circuit board of the lighting circuit is aligned with the LED light sources arranged on another surface of the circuit board along a mounting direction.

3. The LED lighting device according to claim 1, wherein at least one thermal contact portion is embossed from the heat sink to the lighting circuit, and at least one slot having a size slightly larger than that of at least one thermal contact portion is arranged in the mounting portion, wherein the at least one thermal contact portion penetrates the at least one slot and is configured to attach to and in thermal contact with the circuit board of the lighting circuit, and the location of the thermal contact portions in contact with the circuit board are aligned with the LED light sources arranged on another surface of the circuit board.

4. The LED lighting device according to claim 3, wherein an opening is arranged in a middle of the heat sink, the heat sink is provided with a plurality of thermal contact portions arranged along an outer periphery of the opening of the heat sink, at least one slot is arranged in the mounting portion correspondingly, wherein each of the thermal contact portions are attached to the circuit board of the lighting circuit.

5. The LED lighting device according to claim 1, wherein an opening is arranged in a middle of the heat sink, and a corresponding opening is arranged in the mounting portion, a driving element is arranged on at least one surface of the lighting circuit which is not provided with the LED light sources, wherein the driving element penetrates the openings of the mounting portion and the heat sink, and is accommodated in the head portion.

6. The LED lighting device according to claim 1, wherein the LED lighting device is of straight-down type, and the respective elements of the LED lighting device are arranged along an up and down direction; light emitted from the LED light sources are output downwardly.

7. The LED lighting device according to claim 1, wherein the mounting portion and the optical element are connected with each other to assemble the lighting circuit, the mounting portion and the optical element together.

8. The LED lighting device according to claim 1, wherein the heat sink, the mounting portion and the circuit board of the lighting circuit each comprises at least a portion in flat form, and are arranged face to face with each other.

9. The LED lighting device according to claim 8, wherein the heat sink has a flat main portion and an opening arranged in a middle of the main portion; a lower end of the head portion is arranged on an outer periphery of the opening.

10. The LED lighting device according to claim 9, wherein the head portion comprises a head section and an intermediate section which are connected with each other, and a maximum outer diameter of the intermediate section is larger than a diameter of the opening of the heat sink.

11. The LED lighting device according to claim 1, further comprising: a plurality of screws, a plurality of studs are arranged on the head portion, and the screws penetrate through the studs of the head portion, the heat sink, the mounting portion, and the lighting circuit, to latch with the optical element.

12. The LED lighting device according to claim 1, wherein the LED light sources of the lighting circuit are arranged along an outer periphery of the circuit board, and the optical element is arranged with a recessed annular optical portion which is configured to receive the light emitted from the LED light sources and output the light after the light is distributed.

13. The LED lighting device according to claim 12, wherein the optical element comprises a connecting portion disposed in a middle of the optical portion, wherein one end of the connecting portion extends from a center of the optical element and the other end is connected with an inner periphery side of the optical portion.

14. The LED lighting device according to claim 1, wherein the optical element is an optical lens or a diffusion element.

15. A method of making an LED lighting device, comprising:

providing a head portion that is configured for mounting the LED lighting device to an outer installation device and electrically connecting the LED lighting device with an outer power source;

providing a lighting circuit that comprises a circuit board and at least one LED light source arranged on one surface of the circuit board, wherein the lighting circuit is held between a mounting portion and an optical element, and light emitted from the at least one LED light source is output after being distributed by the optical element; and providing a heat sink that is held between the head portion and the mounting portion and includes a flat main portion and an extension formed outwards from an outer periphery of the flat main portion where the extension extends beyond the outermost peripheries of the mounting portion, the lighting circuit, and the optical element, in both a radial direction and a light emission direction wherein at least a portion of the circuit board of the lighting circuit or the heat sink penetrates the mounting portion to make a direct thermal contact between the heat sink and the lighting circuit.

16. The method according to claim 15, wherein a location of a thermal contact portion of the heat sink in the direct thermal contact with the circuit board of the lighting circuit is aligned with the LED light sources arranged on another surface of the circuit board along a mounting direction.

17. The method according to claim 15, wherein at least one thermal contact portion is embossed from the heat sink to the lighting circuit, and at least one slot having a size slightly larger than that of at least one thermal contact portion is arranged in the mounting portion, wherein the at least one thermal contact portion penetrates the at least one slot and is configured to attach to and in thermal contact with the circuit board of the lighting circuit, and the location of the thermal contact portions in contact with the circuit board are aligned with the LED light sources arranged on another surface of the circuit board.

18. The method according to claim 17, wherein an opening is arranged in a middle of the heat sink, the heat sink is provided with a plurality of thermal contact portions arranged along an outer periphery of the opening of the heat sink, at least one slot is arranged in the mounting portion correspondingly, wherein each of the thermal contact portions are attached to the circuit board of the lighting circuit.

19. The method according to claim 15, wherein an opening is arranged in a middle of the heat sink, and a corresponding opening is arranged in the mounting portion, a driving element is arranged on at least one surface of the lighting circuit which is not provided with the LED light sources, wherein the driving element penetrates the openings of the mounting portion and the heat sink, and is accommodated in the head portion.

* * * * *